US006216272B1

(12) United States Patent
Rosengren et al.

(10) Patent No.: US 6,216,272 B1
(45) Date of Patent: Apr. 17, 2001

(54) INTEGRAL VEST FISHING TACKLE CARRIER

(76) Inventors: Paul T. Rosengren, 106 1st St. Southeast, New Prague, MN (US) 56071; Brent L. Rosengren, 2965 Oak Lawn La., Mound, MN (US) 55364

( * ) Notice: Subject to any disclaimer, the term of this patent is extended or adjusted under 35 U.S.C. 154(b) by 0 days.

(21) Appl. No.: 09/610,168

(22) Filed: Jul. 5, 2000

(51) Int. Cl.[7] ..... A41D 1/04
(52) U.S. Cl. ..... 002/102; 2/94
(58) Field of Search ..... 2/94, 102, 108, 2/85, 93, 69; 441/106, 108, 111, 112, 113, 114, 115–119

(56) References Cited

U.S. PATENT DOCUMENTS 2,226,564 * 12/1940 Kienitz ..... 441/106
2,363,639 * 11/1944 Brown ..... 441/106
2,563,122 * 8/1951 Levine ..... 441/106
2,717,391 * 9/1955 Bracken ..... 2/102
3,266,070 * 8/1966 O'Link ..... 2/102
4,799,908 * 1/1989 Lucius ..... 441/115
5,247,707 * 9/1993 Parker et al. ..... 2/102
5,852,828 * 12/1998 Foster ..... 2/102
5,913,409 * 6/1999 Test ..... 2/102

* cited by examiner

*Primary Examiner*—Gloria M. Hale
(74) *Attorney, Agent, or Firm*—Schroeder & Siegfried

(57) ABSTRACT

An integral fishing vest and tackle carrier having elongated front and rear vest panels, each of which includes an upper section and a lower section adapted to be foldable over the upper section, thereby creating a pocketed storage compartment between the upper and lower sections within which fishing tackle may be carried for convenient access. The lower section of each panel is constructed with a guide that is adapted to receive and hold in place at least one tackle carrier with organizing compartments that are easily accessible to the fisherman when the lower section is released and unfolded from the upper section to which it is normally secured. The vest is readily reversible between front and rear panels such that access to either is readily available. The vest may also be optionally constructed as a life vest, with permanent or removable floatation-wear incorporated therein.

32 Claims, 6 Drawing Sheets

1
2
3
5
5
6
7
8
9
15
34
35

1
5
5
6
7
3
32
12
8
9
15
15
14
15
20
21
13
20
15
6
6
19

1
4
15
17
20
20
15
18
9
16
8
15
5
6
5
7
15
9
32
8
14
12
34
13
35
15
20
20
3

INTEGRAL VEST FISHING TACKLE CARRIER

I. DESCRIPTION

Background of the Invention

The present invention is related generally to the art of fishing vests, and more particularly to an integral fishing vest and tackle carrier which is reversible between front and rear panels for convenient access to fishing tackle carried on either side.

The sport of fishing has long since been a favorite pastime of many outdoorsmen. With increased popularity in the sport, numerous advances and developments have been made in an effort to make fishing even more relaxing and enjoyable. Specialized fishing boats, tackle, and fishing-wear have been developed to further enhance the convenience and enjoyment of fishing.

Such advances have also sparked the competitiveness of many fishermen. It is now commonplace for fishing tournaments to be held, where experienced and amateur fisherman alike test their skills against one another and seek the ultimate recognition, and prize purse, which results from being crowned champion of the tournament. With the advent of more powerful boats and improved fishing gear, the competitive fisherman is always looking for an edge over the competition, and during tournament fishing, time is of the essence. For this reason, it is oftentimes desirable for the fisherman to change lures while on the fly from one fishing location to another. In such cases, convenient and efficient accessibility to the fisherman's tackle becomes essential, so as not to lose crucial moments of fishing.

Even in less competitive situations, such as the fisherman who hikes to a distant and favorite fishing hole, the desirability for a more convenient and efficient means for carrying and accessing one's fishing tackle is evident. Whether one is fishing in a tournament, or merely pleasure fishing, the benefits of a conveniently accessible and more efficient means of storing one's fishing tackle are plainly evident.

It is with the above in mind that we have developed our improved integral fishing vest and tackle carrier which, as will be described in more detail hereafter, provides an efficient means for storage and carrying of all necessary fishing tackle, as well as a means for convenient and ready accessibility thereto.

BRIEF SUMMARY OF THE INVENTION

In accordance with the present invention, described herein is an integral fishing vest and tackle carrier which includes front and rear panels that form pocketed storage areas adapted to carry, in a readily accessible manner, containers storing the fisherman's tackle. The front and rear panels of the vest are interconnected at their upper ends by a pair of spaced intermediate shoulder portions, which form a neck opening therebetween. At least one, and preferably both of the panels, include an upper section, and a lower section that is adapted to be foldable over at least a portion of the upper section. A securing means, which is unfastenable, is provided for holding the lower section in a folded closed position over its adjoining upper section. When the lower section is secured in its closed position over the upper section, an enlarged pocket or storage area is formed therebetween, within which tackle containers may be kept. Thus, in the preferred embodiment, where both the front and rear panel of the vest have adjoining upper and lower foldable sections, such a storage compartment is formed on each panel of the vest.

The vest is designed such that the foldable joint between the lower section and upper section of either panel is located near the waist of the fisherman. By constructing the vest in this manner, when the fisherman is seated, as if in a boat, the lower section of the front facing panel may be folded downwardly away from the fisherman, to a position resting on the thighs of the fisherman's legs, thereby exposing the fisherman's tackle.

Each lower section of its respective panel carries a guide means for receiving and holding at least one fishing tackle container therein. Preferably, the fishing tackle container is constructed with multiple compartments for storage and organization of different sized lures and the like, and will include a means for covering such compartments, to prevent dislodgement of the lures from their respective compartments during movement. Such cover(s) are also preferably constructed to open away from the fisherman for convenient and efficient access to the fisherman's tackle.

Notably, the guide means carried by the lower section is adapted to allow removal and replacement of the existing fishing tackle container with other tackle containers. Thus, depending on the type of fish being sought, the fisherman may easily replace one tackle container with another that holds the types of lures that are best suited for the desired fish. With similar storage compartments being available on both the front and rear panels, the fisherman can carry lures for a wide variety of different fish. By simply rotating the vest to reverse the orientation of the front and rear panels, the fisherman may readily switch to a different type of tackle, as desired.

Preferably, our improved fishing vest is constructed of a water-resistant material, and may optionally be constructed as a life vest with permanent or removable floatation means incorporated therein. When in normal use, the front and rear panels have connecting side straps that hold the vest panels in place relative to one another. Should the fisherman decide to reverse the vest for access to the tackle carried in the rear panel, the fisherman need only place their arms inside the side straps and rotate the vest about their neck. Alternatively, the fisherman can disconnect the side straps prior to rotating the vest.

Other and additional compartments may also be incorporated into the outer and/or inner facings of the vest panels for storage of additional lures and fishing gear, such as forceps, spare line, maps, a knife, etc. It is further contemplated that the vest may also incorporate a rod and reel holster which may be useful to the fisherman during hiking through rough terrain.

It is evident from the above that our improved integral fishing vest and tackle carrier offers substantial benefits of increased efficiency and convenient accessibility to a fisherman's tackle. The tackle is always at the fisherman's fingertips, and whether sitting in a boat or elsewhere, by simply unfolding the lower section of the front facing panel, the tackle becomes conveniently accessible to the fisherman. This provides substantial benefit to the fisherman who wishes to switch lures on the fly, and also provides a convenient and efficient means for storing the fisherman's tackle during extended hiking trips, etc.

These and other objects and advantages of the invention will more fully appear from the following description, made in connection with the accompanying drawings, wherein like reference characters refer to the same or similar parts throughout the several views, and in which:

DETAILED DESCRIPTION OF THE INVENTION

Figure 1:
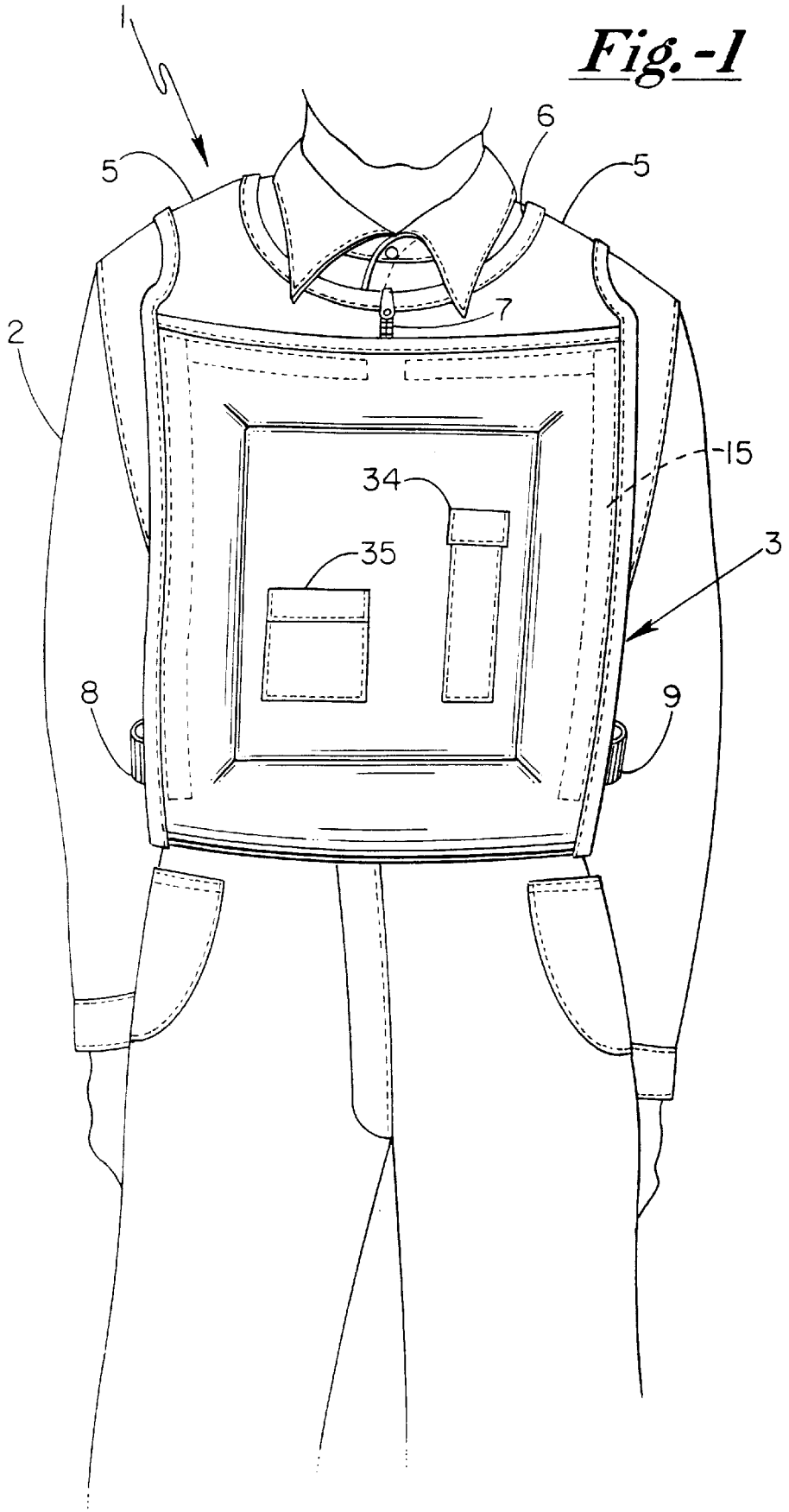
FIG. 1 is front elevational view of an integral fishing vest tackle carrier which is the subject of my invention, shown worn by a fisherman in its intended manner.

In accordance with the present invention, shown in FIG. 1 is our integral fishing vest and tackle carrier 1 shown worn by a typical fisherman 2 in its intended manner. As can be seen best in FIGS. 1 and 2, vest 1 includes a front panel 3 and a rear panel 4 that are interconnected by intermediate shoulder portions 5 extending therebetween. Shoulder portions 5 define a central neck opening 6 for placement over the head of the fisherman, as shown in FIG. 1. Zipper 7 is provided to allow adjustability of the size of neck opening 6 as desired or needed. Lateral side straps 8 and 9 are provided to secure the front and rear panels 3 and 4 of the vest 1 in tight conforming position to the fisherman's body during use. Each strap 8 and 9 includes a clasp mechanism comprising a male latch member 10 and a female catch member 11 which interconnect in releasable relation for easy access and removal of life vest 1 when desired. Straps 8 and 9 may be tightened or loosened through adjustability thereof in a conventional manner.

Figure 2:
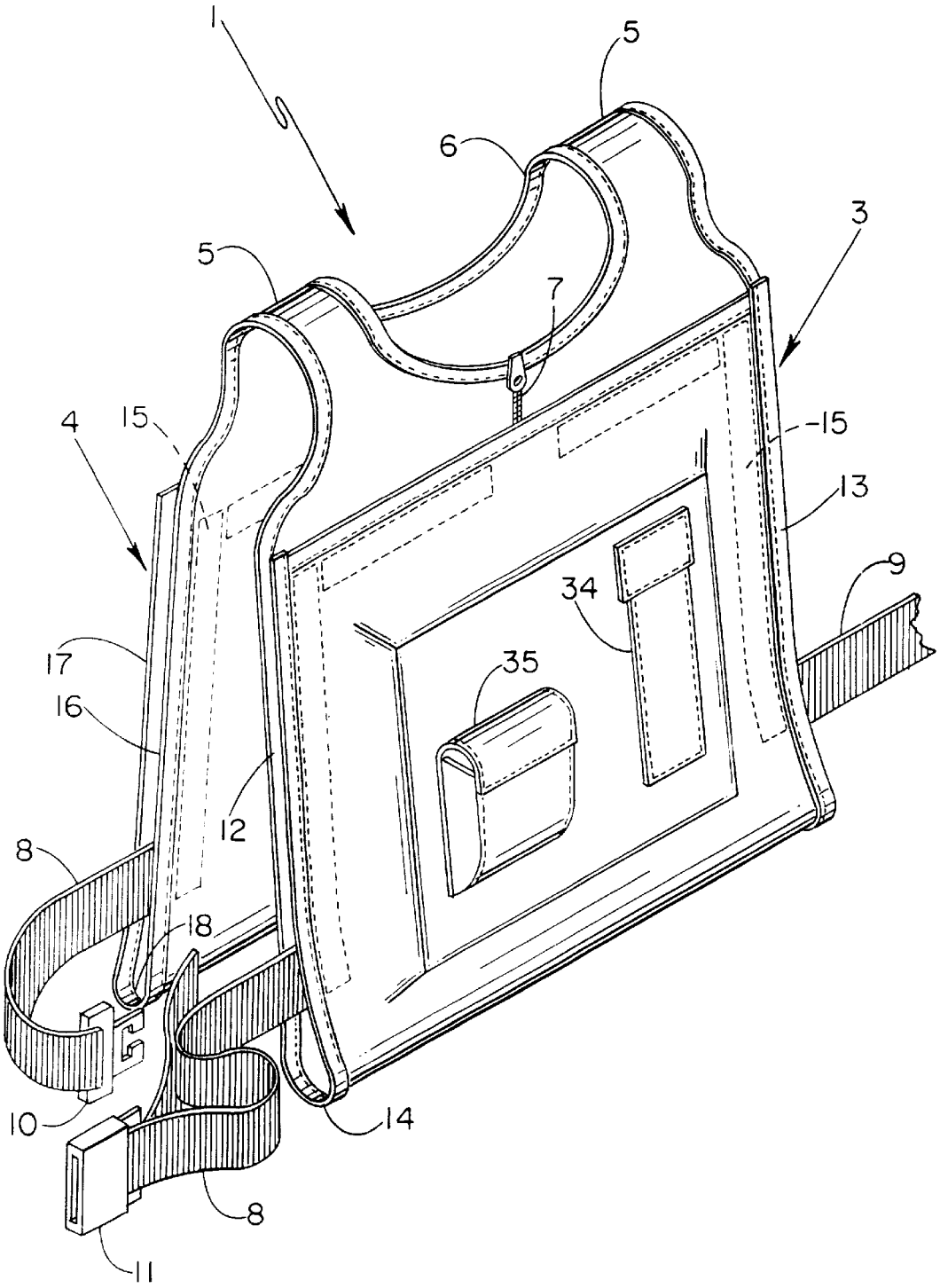
FIG. 2 is a perspective view of our integral fishing vest tackle carrier, showing the construction thereof, with similarly configured front and rear panels.
Figure 3:
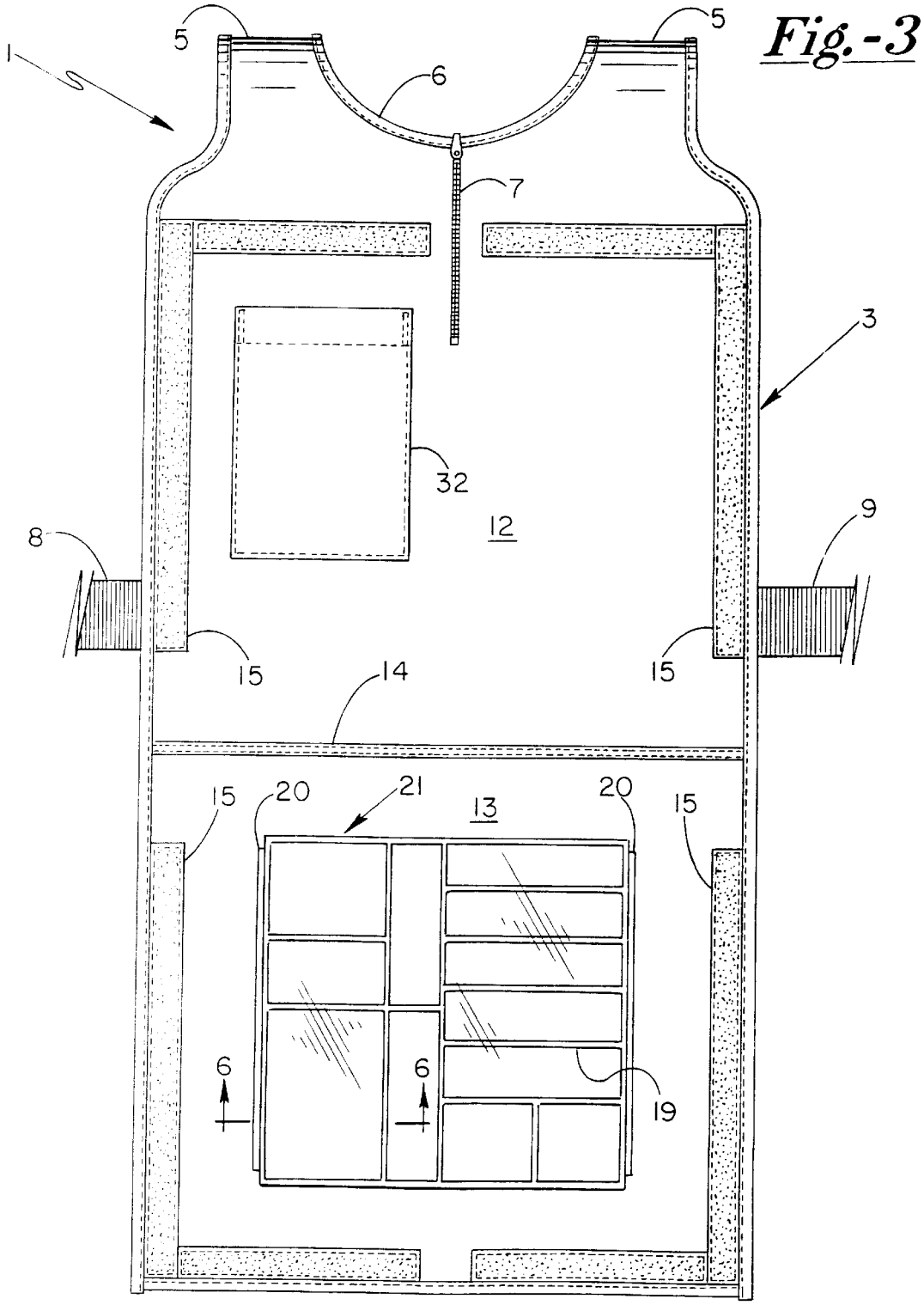
FIG. 3 is another front elevational view of our integral fishing vest tackle carrier, showing the lower section of the front panel unfolded from the upper section, and a fishing tackle container being removably carried by the lower section thereof.
Figure 4:
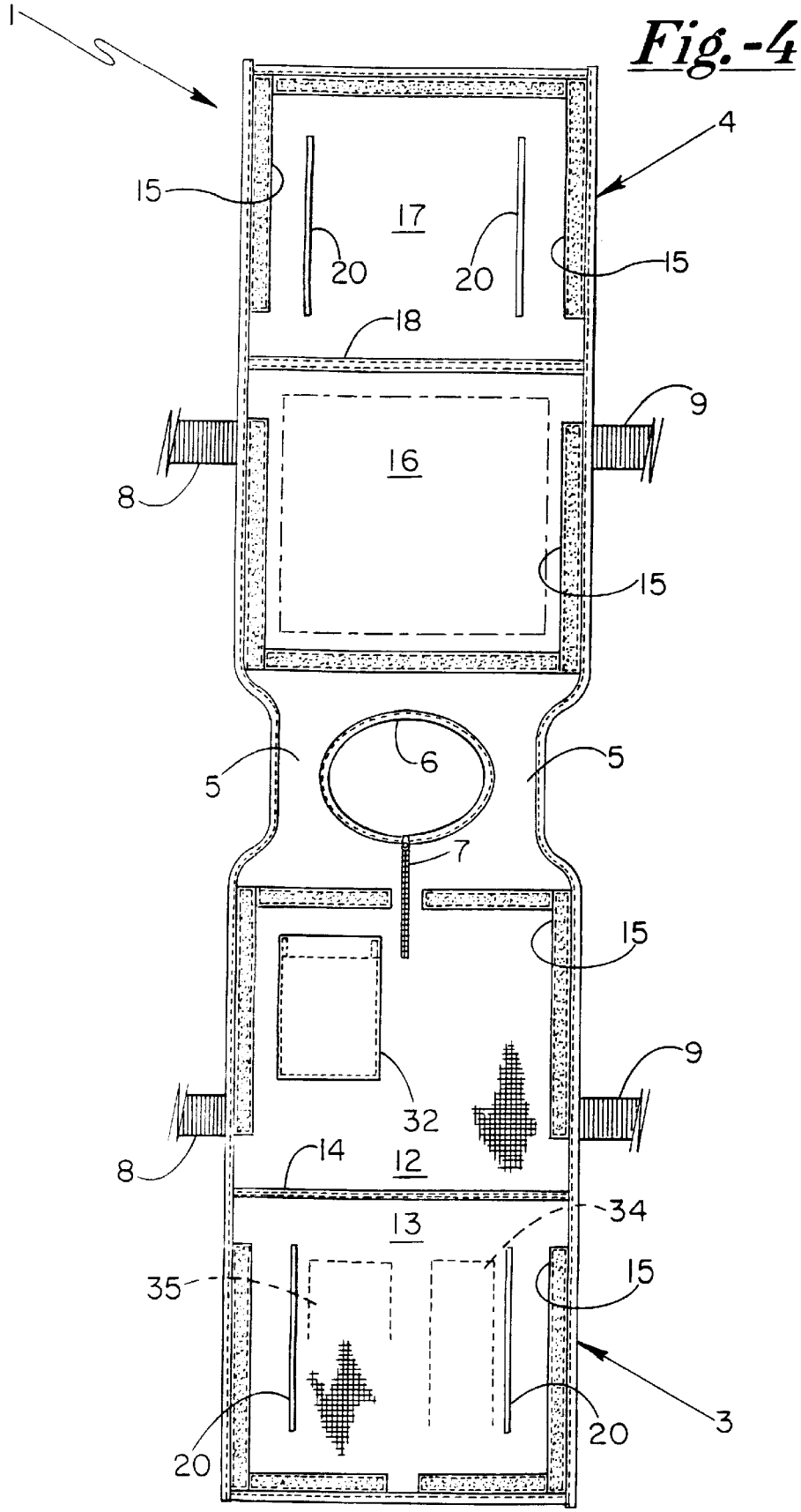
FIG. 4 shows a top plan view of our integral fishing vest tackle carrier, with both front and rear panels shown expanded outwardly with the lower sections thereof unfolded relative to the upper sections, and showing the guide means carried by the lower sections of both panels for removably carrying a fishing tackle container thereon.

As shown best in FIGS. 2 through 4, in the preferred embodiment, both the front and rear panels 3 and 4 include an upper section, and a lower section that is adapted to be foldable over at least a portion of the upper section. More specifically, as best seen in FIGS. 3 and 4, front panel 3 of vest 1 includes an upper section 12 and a lower section 13 which are foldably interconnected at joint 14 therebetween. A readily unfastenable securing means 15, such as the Velcro hook and loop-type connector, extends about the upper end and both sides of upper section 12, and correspondingly about the lower end and two sides of lower section 13 of panel 3. Securing means 15 functions to hold upper and lower sections 12 and 13 together in folded closed relation, as shown in FIG. 2. Optionally, a zipper or other releasable securing device may be used for this purpose.

In like manner, as best seen in FIG. 4, rear panel 4 may also be configured similarly to front panel 3, with an upper section 16 and a lower section 17 interconnected in foldable relation with flexible joint 18 therebetween. Similar securing means 15 is also provided about three faces of the upper and lower sections 16 and 17 for holding the same together in folded, closed relation. As shown in FIG. 2, when the respective lower section of either panel 3 or 4 is secured in its closed position over its adjoining upper section, an enlarged pocket or storage area is formed therebetween, the purpose for which will be explained hereafter. Thus, in the preferred embodiment, where both the front panel 3 and rear panel 4 of the vest 1 have adjoining upper and lower foldable sections, such an enlarged storage compartment is formed on each panel of the vest.

Figure 6:
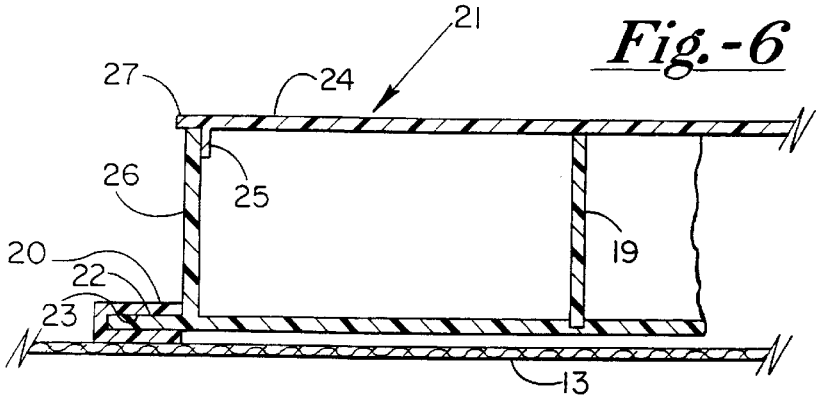
FIG. 6 is a cross-sectional view taken along lines 6—6 of FIG. 3, showing the construction of the fishing tackle container and the sliding guide means therefor that is attached to the lower section of one or both the front and rear panels.

With further reference to FIGS. 3 and 4, it can be seen that the lower sections 13 and 17 of the respective front and rear panels each carry guide means 20 which is constructed to receive in readily removable relation a fishing tackle storage container 21. As shown in FIG. 6, container 21, which is preferably manufactured from a lightweight, water-resistant material, such as plastic, is constructed with a pair of side flanges 22 that extend outwardly for slidable engagement within channel 23 of adjacent guide means 20. In this manner, containers 21 are slidable within guide means 20 and readily removable therefrom, as desired.

Figure 5:
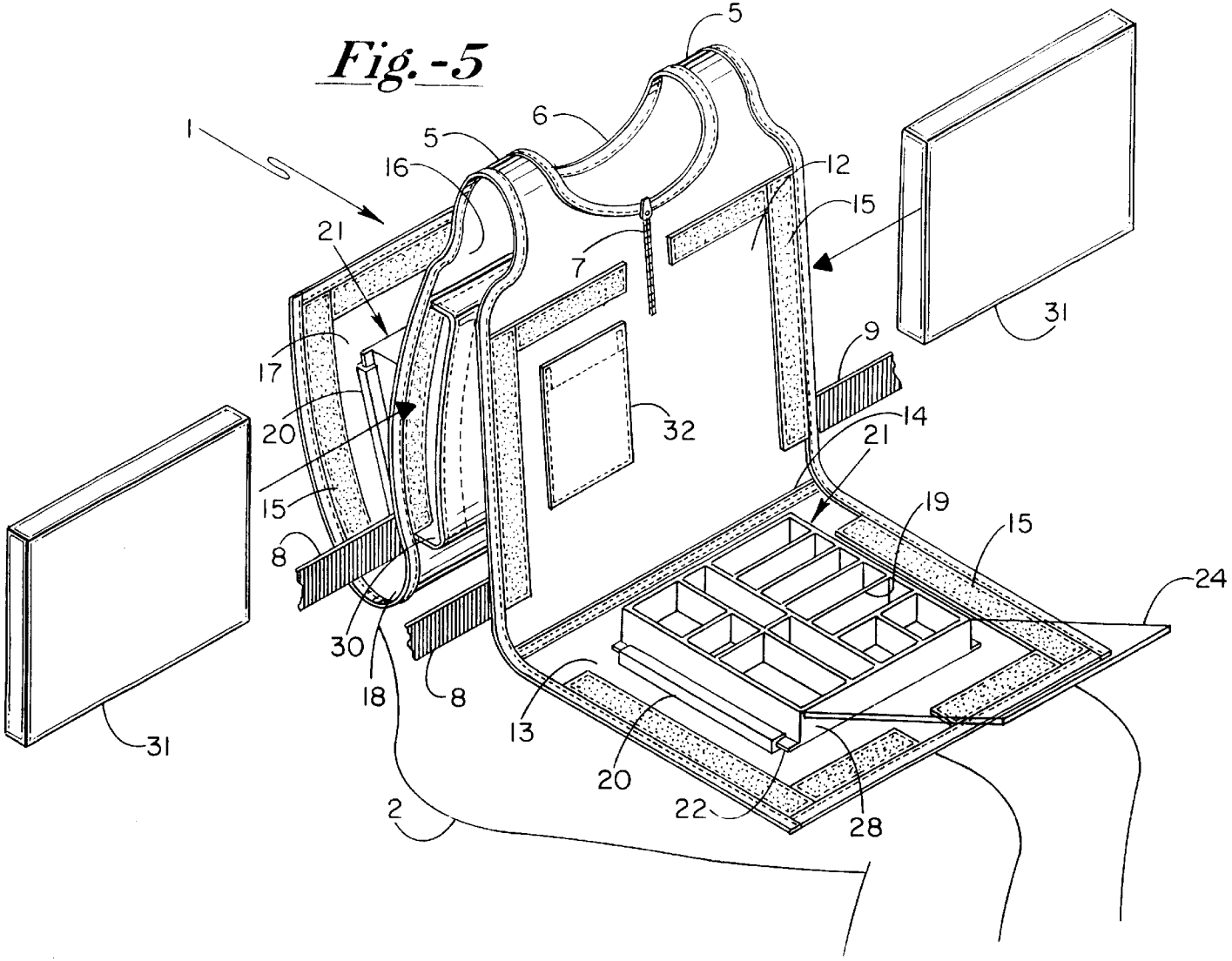
FIG. 5 is another perspective view of our integral fishing vest tackle carrier, showing the manner in which the lower section of either panel may rest on a fisherman's lap for easy access to the fishing tackle container, and further showing the option of incorporating floatation means to convert the vest into a life vest.
Figure 7:
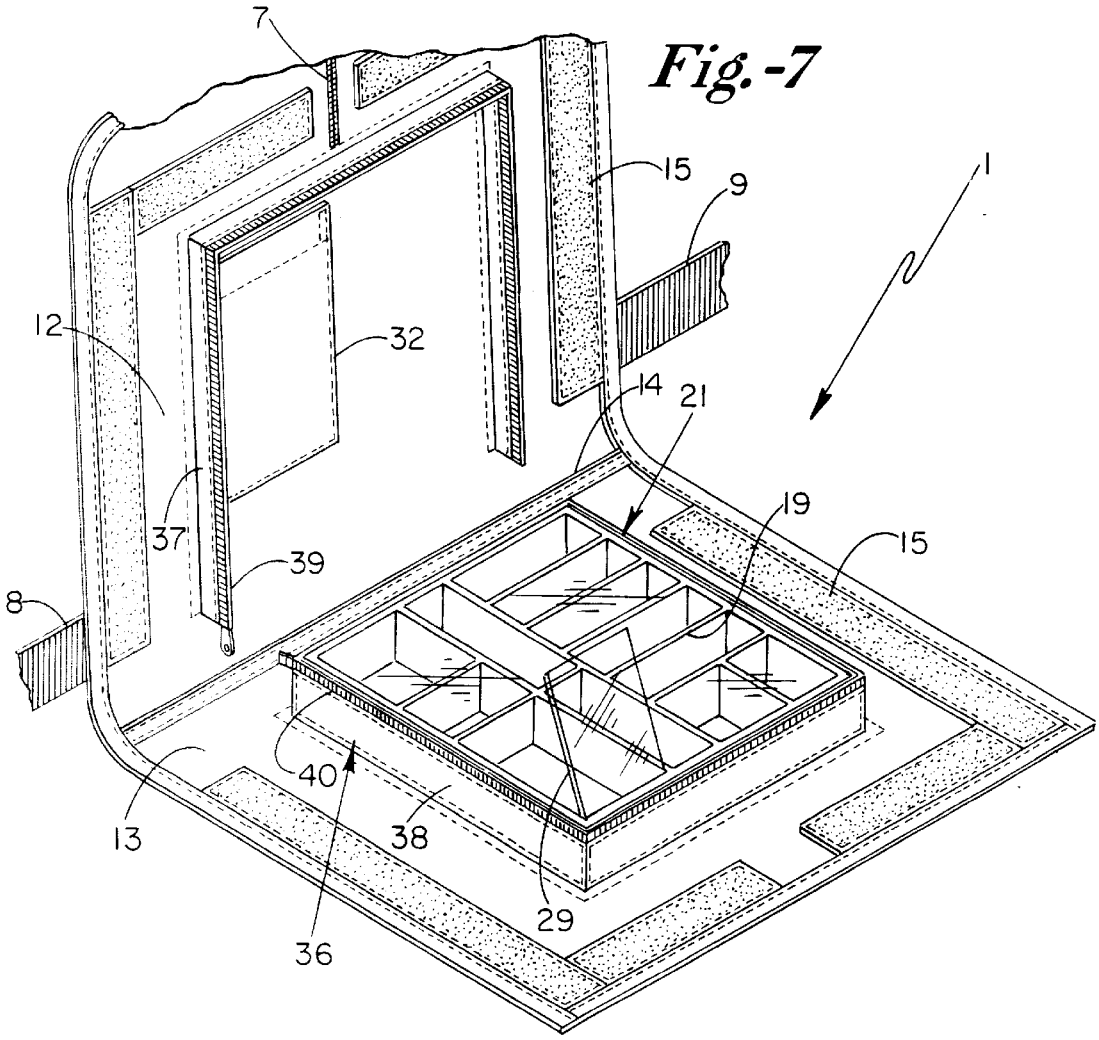
FIG. 7 is another perspective view showing our integral fishing vest tackle carrier with an optional zipper compartment formed between the upper and lower sections of a panel for further enclosing and securing a fishing tackle container therein.

As seen in FIG. 5, the fishing tackle container 21 is constructed with multiple compartments for storage and organization of different sized lures and the like. Preferably, dividers 19 are removable to provide flexibility in dividing and adjusting the size of the individual compartments. Container 21 also includes a cover 24 to enclose the compartments, so as to prevent dislodgement of the lures from their respective compartments during movement. As shown in FIG. 6, cover 24 is also preferably constructed with a detent 25 that frictionally engages end wall 26 of container 21 so as to lock the cover when closed. Lip 27 or other grasping means may also be incorporated into cover 24 or end wall 26 to help facilitate the opening of cover 24. Notably, cover 24 is hingedly connected at the end 28 furthest from the fisherman's body, such that it will pivot away from the fisherman for convenient and efficient access to the fisherman's tackle. Optionally, as shown in FIG. 7, each compartment of is container 21 may be designed with its own individual cover 29 of similar construction for ease of access to the individual compartments, as desired.

As noted previously, and as shown in FIG. 5, vest 1 preferably includes two fishing tackle storage containers 21, one each stored in the enlarged storage compartments formed between the upper and lower sections of the front and rear panels 3 and 4 (rear panel 4 is shown slightly open in FIG. 5 to illustrate storage of container 21). With the guide means 20 carried by the respective lower sections 13 and 17, it can be seen that containers 21 are adapted for removal and replacement with other similarly configured containers. Thus, depending on the type of fish being sought, the fisherman may easily replace one tackle container with another that holds the type of lures that are best suited to the desired fish. Notably, as seen in FIG. 5, vest 1 is designed such that the foldable joints 14 and 18 between the lower and upper sections of front panel 3 and rear panel 4 are located near the waist of the fisherman wearing the same. By so constructing the vest in this manner, when the fisherman is seated, as if in a boat, the lower section of the front-facing panel may be folded downwardly away from the fisherman, to a position resting on the thighs of the fisherman's legs, thereby exposing the fisherman's tackle container 21.

With similar tackle storage containers 21 being available on both the front and the rear panels 3 and 4 of vest 1, the fisherman can carry lures for a wide variety of different fish. By simply rotating the vest 1 to reverse the orientation of the front and rear panels, the fisherman may readily switch to another type of tackle, as desired. To accomplish this, the fisherman need only place his/her arms inside the side straps 8 and 9, and rotate the vest 1 about his/her neck. Alternatively, the fisherman may disconnect the latch 10 connecting the side straps 8 and 9 prior to rotating the vest.

As a fishing vest, vest 1 is preferably constructed of a water-resistant material, or of a material such as polyester, cotton, or nylon, which is treated for water-resistance. Vest 1 may also optionally be constructed as a life vest with permanent or removable floatation means incorporated therein. As shown in FIG. 5, side pockets 30 may be incorporated on the inside face of upper sections 12 and 16 of the front and rear panels which are designed to receive removable floatation devices 31 therein. Similar unfastenable securing means, such as Velcro, may also be used to close pockets 30. Alternatively, it is contemplated that the floatation means could also be of a type that automatically inflates upon pulling an activation cord, much like those used in commercial airplanes. With the incorporation of such floatation means, our improved fishing vest 1 may also function as an approved life vest, thereby obviating the need for the fisherman to wear an additional and separate life preserver.

As an additional option, it is also contemplated that vest 1 may include additional storage pockets for other utensils and spare items commonly used in fishing. For instance, as further shown in FIG. 5, a storage compartment 32 for a map or the like may be sewn or otherwise secured to the outside face of one of the upper sections 12 or 16 of the front or rear panels 3 or 4. Upon closure of the lower section over the upper section, pocket 32 is kept relatively secure from elements such as rain or wind. Optionally, an overlaying flap may be incorporated into the pocket to further secure the contents therein. Similarly, as shown in FIGS. 1 and 2, additional storage pockets may be incorporated into vest 1 for other items such as forceps, spare line, etc.; and vest 1 may also be constructed to incorporate a rod or reel holster, which may be useful to the fisherman when hiking through rough terrain.

With reference to FIG. 7, as still another alternative, it is further contemplated that a jacket 36 may be incorporated into vest 1 to further secure the contents of the fishing tackle container 21 during transportation. More specifically, as shown in FIG. 7, jacket 36 includes opposing wall sections 37 and 38, each of which is constructed of a flexible fabric material with mating zipper portions 39 and 40 incorporated therein. As can be seen in FIG. 7, wall section 37 is secured to the outer face of upper section 12 of front panel 3 and extends about three sides of an area designed to border container 21. Similarly, wall section 38 is secured to the inner face of lower section 13 of front panel 3, and also extends about three sides of a corresponding area bordering container 21. With lower section 13 moved to a near closed position, mating zipper portions 39 and 40 on walls 37 and 38 may be zipped shut to further enclose container 21 for safekeeping during traveling. Of course, it will be s appreciated that a similar jacket 36 may also be incorporated into the rear panel 4 of vest 1 to enclose the fishing tackle container 21 carried thereby.

In operation, depending upon the type of fish being sought by the fishermen, storage containers 21 containing the appropriate tackle may be selected and loaded into the front and rear panels 3 and 4 of vest 1 by sliding the same within the appropriate channel guide means 20 secured to the lower sections thereof. For securement during traveling, the optional jacket 36 carried on each side of the vest may be zipped shut so as to enclose container 21 within the enlarged storage compartment formed between the upper and lower sections of the respective front and rear panels 3 and 4.

With the appropriate fishing tackle containers 21 loaded in vest 1, vest 1 may be placed over the head of the fishermen as shown in FIG. 1, and straps 8 and 9 may be secured and tightened to hold the vest in proper position against the fishermen's body. The orientation of the vest (i.e., either the front panel 3 or rear panel 4 facing forward) will be dependent upon which type of fish will be sought first by the fishermen.

Whether the fishermen is fishing by boat, or on shore, once he/she has reached a desired fishing hole, the releasable securing means 15 and jacket 36 may be unfastened, thereby allowing the lower section of the forward facing panel to unfold from the upper section to a position on the fishermen's lap, and shown in FIG. 5. As such, fishing tackle stored in container 21 is now readily accessible to the fishermen, and by opening lid 24, the fishermen may select the desired lure with relative ease. After selection of the appropriate lure is made, the fishermen need only close lid 24 and fold the lower section of the forward facing panel upwardly to cause securing means 15 to once again engage, thereby holding the lower section in its closed position relative to its adjoining upper section, as shown in FIG. 2.

With the fishing tackle at the fishermen's finger tips, the fishermen may rapidly change lures and/or move to other fishing locations with relative ease and convenience. Should the fishermen choose to seek other fish or use other lures stored in the container 21 on the rear panel 4 of vest 1, the fishermen need only place their arms inside the side straps 8 and 9 and rotate the vest about their neck. Alternatively, as previously stated, the fishermen may also disconnect the side straps prior to rotating the vest.

From the above, it can be seen that substantial benefits of increased efficiency and convenient accessibility to a fisherman's tackle can be achieved through the use of our improved integral fishing vest and tackle carrier. Whether sitting in a boat, or elsewhere, a fisherman may simply unfold the lower section of the front facing panel of vest 1 to bring his fishing tackle to his fingertips. Whether fishing for leisure or in competition, our improved fishing vest allows the fisherman to switch lures on the fly, and conveniently and quickly store and change lures on his/her lap. Once the fisherman has changed a lure, the lower section of the front facing panel may simply be closed and automatically secured to the upper section until he/she wishes again to change bait.

It will, of course, be understood that various changes may be made in the form, details, arrangement and proportions of the parts without departing from the scope of the invention which comprises the matter shown and described herein and set forth in the appended claims.

What is claimed is:

1. An integral fishing vest and tackle carrier, comprising:

a. a vest having a front panel and a rear panel interconnected by intermediate shoulder portions;

b. at least said front panel having an upper section and a lower section with an axis of pivot therebetween, said lower section being foldable between an open free position and a closed folded position covering at least a portion of said upper section;

c. means for removably securing said lower section in said closed position over said upper section; and d. a fishing tackle carrying means being carried between said upper and lower sections of said front panel when said lower section is folded into said closed position over said upper section thereof.

2. The fishing vest of claim 1, wherein said fishing tackle carrying means is removably secured to said lower section of said front panel.

3. The fishing vest of claim 2, wherein said lower section of said front panel includes a guide means for receiving said fishing tackle carrying means in removable relation thereto.

4. The fishing vest of claim 3, wherein said guide means slidably receives said fishing tackle carrying means in removable relation thereto.

5. The fishing vest of claim 4, wherein said fishing tackle carrying means includes a base member, the peripheral portions of which define a pair of outwardly extending flange members, and said guide means includes a pair of channel members for s slidably receiving said flange members.

6. The fishing vest of claim 1, wherein said fishing tackle carrying means includes a cover pivotally connected thereto.

7. The fishing vest of claim 6, wherein said cover is constructed and arranged for pivotal movement between an open and closed position about an axis of pivot substantially parallel to said axis of pivot between said upper and lower sections of said front panel.

8. The fishing vest of claim 7, wherein said cover is constructed and arranged for pivotal movement away from said upper section of said front panel when said lower section of said front panel is disposed in said open free position.

9. The fishing vest of claim 1, wherein said fishing tackle carrying means includes a plurality of separate compartments, each of which has pivotally connected thereto a cover.

10. The fishing vest of claim 9, wherein each said cover is constructed and arranged to pivot away from said upper section of said front panel when said lower section of said front panel is disposed in said open free position.

11. The fishing vest of claim 1, wherein said lower section of said front panel is constructed and arranged to fold downward and outward away from said upper section of said front panel to said open free position.

12. The fishing vest of claim 1, wherein said front and rear panels of said vest are interconnected along each of their sides by an adjustable connector.

13. The fishing vest of claim 1, wherein said vest includes flotation means for providing buoyancy thereto.

14. The fishing vest of claim 13, wherein said flotation means is removable from said vest.

15. The fishing vest of claim 1, wherein said rear panel carries a second fishing tackle carrying means.

16. The fishing vest of claim 15, wherein said rear panel includes an upper section and a lower section, said lower section of said rear panel being foldable between an open free position and a closed folded position covering said upper section of said rear panel.

17. The fishing vest of claim 16, including means for removably securing said lower section of said rear panel in said closed folded position over said upper section of said rear panel.

18. The fishing vest of claim 17, wherein said second fishing tackle carrying means is carried between said upper and lower sections of said rear panel when said lower section of said rear panel is disposed in said closed folded position over said upper section of said rear panel.

19. The fishing vest of claim 18, wherein said second fishing tackle carrying means is removably secured to said lower section of said rear panel.

20. The fishing vest of claim 19, wherein said lower section of said rear panel includes a channel guide means adapted for receiving said second fishing tackle carrying means in slidably removable relation.

21. The fishing vest of claim 20, wherein said second fishing tackle carrying means includes a cover pivotally connected thereto.

22. The fishing vest of claim 20, wherein said second fishing tackle carrying means includes a plurality of separate compartments, each of which includes a separate cover pivotally connected thereto.

23. The fishing vest of claim 18, wherein said second fishing tackle carrying means includes a cover pivotally connected thereto.

24. The fishing vest of claim 23, wherein said cover to said second fishing tackle carrying means is constructed and arranged to pivot away from said upper section of said rear panel when said lower section thereof is disposed in said open free position.

25. The fishing vest of claim 18, wherein said second fishing tackle carrying means includes a plurality of separate compartments, each of which includes a separate cover pivotally connected thereto.

26. The fishing vest of claim 25, wherein each said cover to said second fishing tackle carrying means is constructed and arranged to pivot away from said upper section of said rear panel when said lower section thereof is disposed in said open free position.

27. An integral fishing vest and tackle carrier, comprising:

a. a buoyant life support vest being constructed of a water-resistant material and including a front panel and a rear panel interconnected by intermediate shoulder portions;

b. said front and rear panels of said vest each having an upper section and a lower section, said lower section of said front panel being foldable between an open free position and a closed folded position covering at least a portion of said upper section of said front panel, and said lower section of said rear panel being foldable between an open free position and a closed folded position covering at least a portion of said upper section of said rear panel;

c. means for removably securing said lower section of each respective said front and rear panel in said closed position over the respective said upper section thereof;

d. a first carrying means for fishing tackle being carried between said upper and lower sections of said front panel when said lower section is folded into a closed position over said upper section thereof, said first tackle carrying means being removably secured to said lower section of said front panel; and e. a second carrying means for fishing tackle being carried between said upper and lower sections of said rear panel when said lower section is folded into said closed position over said upper section thereof, said second tackle carrying means being removably secured to said lower section of said rear panel.

28. The fishing vest of claim 27, wherein said lower section of said front and rear panels are constructed and arranged to pivot downwardly and outwardly away from the respective said upper sections thereof.

29. The fishing vest of claim 27, wherein said lower sections of said front and rear panel each include a channel guide means for slidably receiving and removably securing said first and second tackle carrying means thereto.

30. The fishing vest of claim 27, wherein said first and second tackle carrying means each include a plurality of storage compartments and a cover means pivotally connected thereto for covering said storage compartments.

31. The fishing vest of claim 30, wherein each of said plurality of storage compartments includes a separate cover pivotally connected thereto.

32. An integral fishing vest and tackle carrier, comprising:

a. a life support vest being constructed of water resistant material and including a removable floatation means for buoyancy, said vest having a front panel and a rear panel interconnected by intermediate shoulder portions;

b. said front and rear panels each having an upper section and a lower section, said lower section of each said front and rear panel being foldable between an open free position and a folded closed position covering at least a portion of the respective said upper section thereof;

c. means for removably securing said lower section of each said front and rear panel in said closed position over the respective said upper sections thereof;

d. a first carrying means for fishing tackle being carried between said upper and lower sections of said front panel when said lower section is folded into said closed position over said upper section thereof, said lower section of said front panel including guide means for slidably receiving and removably securing said first tackle carrying means thereto;

e. a second carrying means for fishing tackle being carried between said upper and lower sections of said rear panel when said lower section is folded into said closed position over said upper section thereof, said lower section of said rear panel including guide means for slidably receiving and removably securing said second tackle carrying means thereto; and f. said first and second tackle carrying means each including a plurality of storage compartments and at least one pivotally connected cover for covering said compartments.

* * * * *